United States Patent [19]

Bucher

[11] Patent Number: 5,035,268

[45] Date of Patent: Jul. 30, 1991

[54] PICKING BELT FOR A GRIPPER WEAVING MACHINE

[75] Inventor: Robert Bucher, Frick, Switzerland

[73] Assignee: Sulzer Brothers Limited, Switzerland

[21] Appl. No.: 384,174

[22] Filed: Jul. 21, 1989

[30] Foreign Application Priority Data

Jul. 22, 1988 [CH] Switzerland ..... 2817/88

[51] Int. Cl. ..... D03D 47/24

[52] U.S. Cl. ..... 139/449; 474/260; 428/245

[58] Field of Search ..... 474/260, 263, 264, 268; 428/902, 245, 246, 257; 156/137, 138, 139, 140; 139/449, 441, 444, 445, 446

[56] References Cited

U.S. PATENT DOCUMENTS

| | | | |
|---|---|---|---|
| 2,135,057 | 11/1938 | Slayter et al. . | |
| 2,425,575 | 8/1947 | Suloff | 474/260 X |
| 4,010,655 | 3/1977 | Pollard | 474/268 X |
| 4,112,983 | 9/1978 | Oderbolz et al. | 139/449 |
| 4,522,869 | 6/1985 | Anderson, Jr. et al. | 474/260 X |
| 4,564,053 | 1/1986 | van Bogaert | 139/449 |
| 4,624,288 | 11/1986 | Pezzoli | 139/449 |
| 4,678,455 | 7/1987 | Hollaway, Jr. | 474/263 |
| 4,690,177 | 9/1987 | Gehring et al. | 139/449 |
| 4,771,815 | 9/1988 | Tamaro | 139/449 |
| 4,773,895 | 9/1988 | Takami et al. | 474/263 |

FOREIGN PATENT DOCUMENTS

| | | | |
|---|---|---|---|
| 0199545 | 10/1986 | European Pat. Off. . | |
| 0253184 | 1/1988 | European Pat. Off. . | |
| 3042054 | 6/1982 | Fed. Rep. of Germany . | |
| 2357673 | 2/1978 | France . | |
| 2582322 | 11/1986 | France . | |
| 1400557 | 7/1975 | United Kingdom | 474/260 |

*Primary Examiner*—Andrew M. Falik
*Attorney, Agent, or Firm*—Kenyon & Kenyon

[57] ABSTRACT

A picking mechanism comprises a flexible picking belt for securing to a belt wheel and made of plastics reinforced by a number of stranded and/or bunched groups of fibers. The fiber groups are disposed in an insert extending over the entire length of the picking belt and surrounded by a layer of plastics constituting the picking belt and free from the fiber in the fiber groups. The picking belt has an end portion remaining outside the winding area of the belt wheel and formed with a web-like raised part. The easily-manufactured, low-weight picking belt prevents exposure of fiber in the fiber group during a long period of operation.

18 Claims, 3 Drawing Sheets

XIV
XIV
III
XI
XI
1
2
3
5
5a
5b
6
7
8
9
10
10a
10b
10c
10d
10d'
10'
11
12
12a
13
14
15
15a
16
17
18
20
21
22
23
24
25
27
A
B
C
T

PICKING BELT FOR A GRIPPER WEAVING MACHINE

This invention relates to a picking belt for a gripper weaving machine and, more particularly, to a picking mechanism in a gripper weaving machine.

Heretofore, various types of picking mechanisms have been known for use in a gripper weaving machine. For example, European Patent Application 0253184 and French Patent 2,357,673 describe picking mechanisms wherein a gripper head can be moved into and out of a shed of yarns by means of a flexible belt secured to a wheel which can be oscillated from time-to-time. As is known, the flexible picking belts can be made of a plastic material which is reinforced with fibers.

It has also been known to construct various types of drive belts with various types of reinforcement, such as described in U.S Pat. Nos. 2,135,057; European Patent Application 0199545; and French Patent 2,582,322. In particular, it has been known from U.S. Pat. No. 4,112,983 and Swiss Patent 596,355 to construct a picking belt of a plastic such as an epoxy or phenol material reinforced with carbon fibers. Prior-art picking belts of this kind comprise e.g., a strip from a plastics plate reinforced over its entire length and width by a layer of bunched fibers intersecting in the longitudinal and transverse direction. In order to manufacture the picking belts, the strips are stamped out of the plate and subsequently ground at the cut edges. However, this requires a relatively large amount of machining. Further, when picking belts are manufactured in this way, the plastic layer surrounding the bunched fibers may become worn during weaving, particularly at the cut edges of the transversely extending fiber strands at the side edge regions of the picking belt. Thus, the fiber ends are exposed and weft threads can catch on them when the picking belts travel through the shed, resulting in faulty weaving.

Accordingly, it is an object of the invention to prevent parts of fibers from coming out of a picking belt and interfering with weaving.

It is another object of the invention to provide an improved picking mechanism which avoids catching of weft threads thereon during a picking operation.

It is another object of the invention to provide an improved picking belt for a picking mechanism having an improved operating life.

It is another object of the invention to reduce the downtime of a gripper weaving machine caused by a need to change a picking belt.

Briefly, the invention provides a picking belt for a gripper weaving machine which is comprised of a strip-like plastic body and a longitudinally extending insert within the outer surface of a body and which includes a plurality of longitudinally extending reinforcing fibers. In this construction, the reinforcing fibers are protected against becoming exposed to the outer surfaces of the plastic body during wear of the surfaces. To this end, the plastic body provides an outer cross-sectional part which is free of fibers and which forms a protective covering for the reinforcing insert.

The picking belt may also be provided with at least one raised part which projects from a surface of the body and which extends longitudinally over at least an end part of the length of the body.

The picking belt is particularly useful in a picking mechanism employing an oscillating belt wheel and a gripper head for reciprocating into and out of a shed of warp yarn. In this respect, the flexible picking belt is secured at one end to the wheel for winding thereon while the other end is secured to the gripper head for reciprocating the head. A guide rail may also be disposed between the wheel and gripper head to slidably receive the end portion of the belt as well as any raised part on the end portion of the belt.

These and other objects and advantages of the invention will become more apparent from the following detailed description taken in conjunction with the accompanying drawings wherein.

Figures 1, 2, 2A:
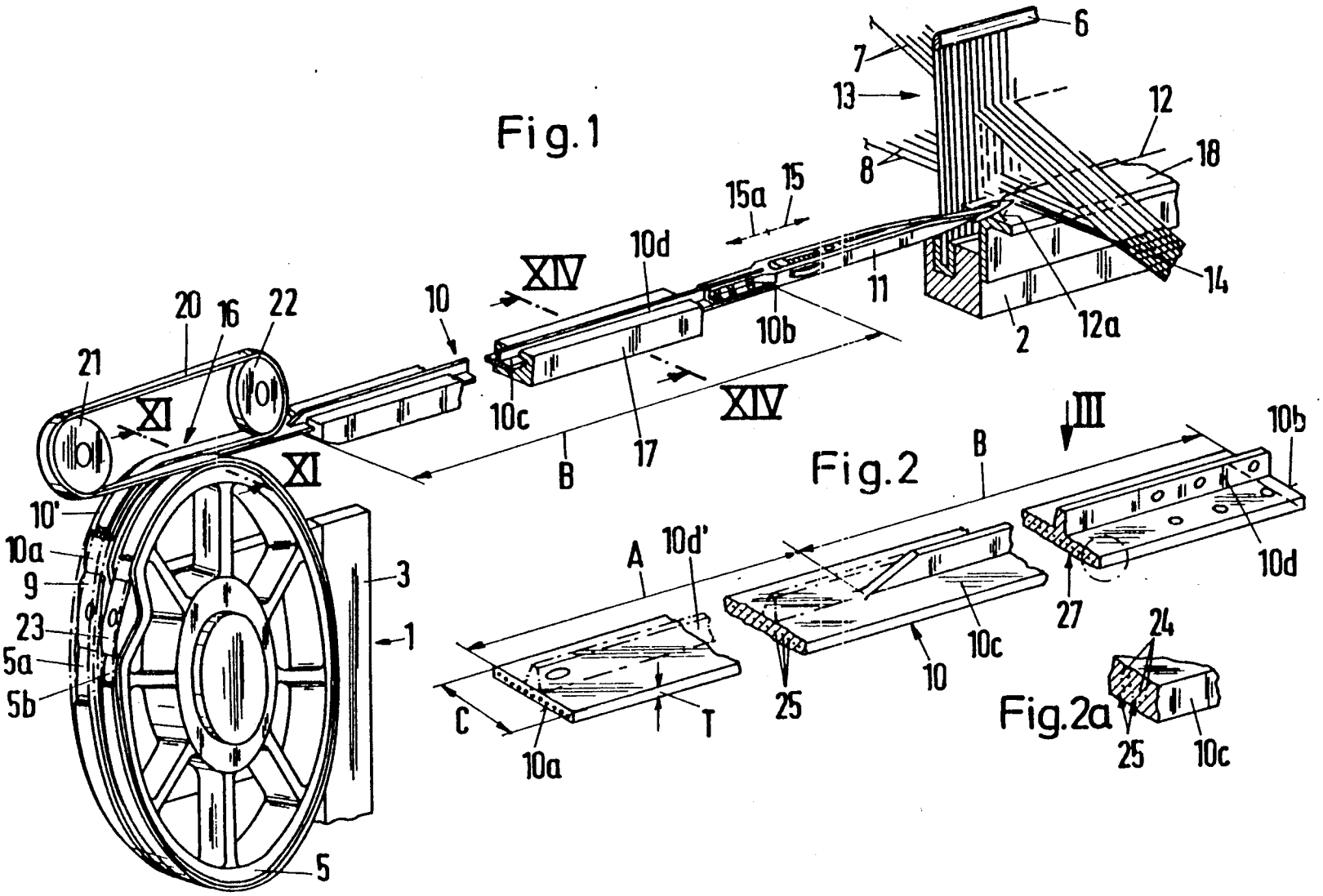
FIG. 1 illustrates a perspective partial view of a picking mechanism employing a picking belt in accordance with the invention.
FIG. 2 illustrates an exploded view of a part of a picking belt constructed in accordance with the invention.
Figure 3:
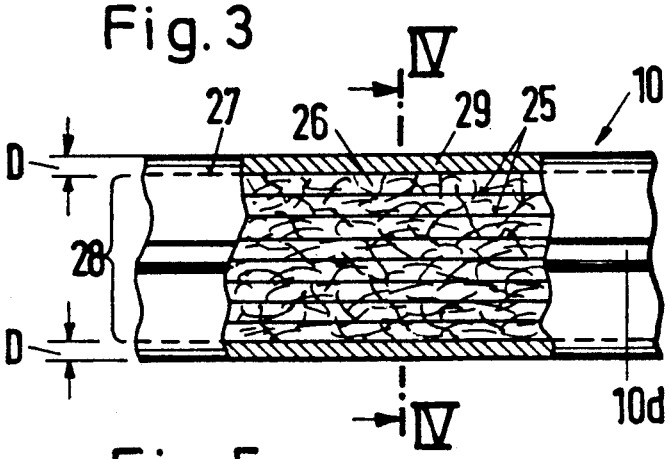
Figure 4:
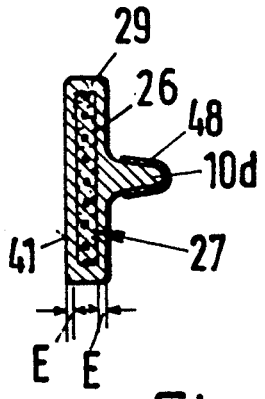
Figure 5:
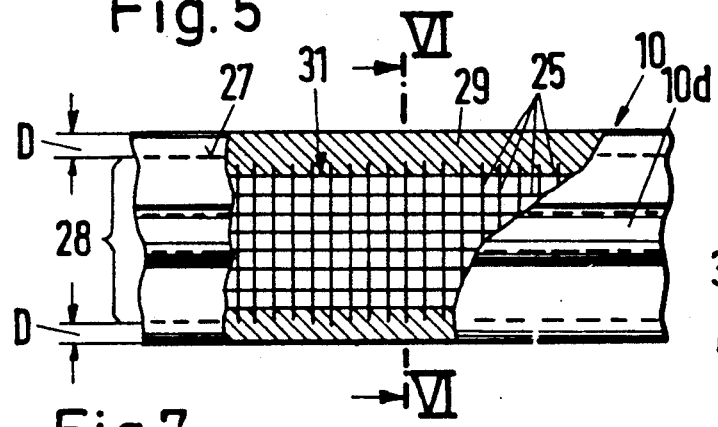
Figure 6:
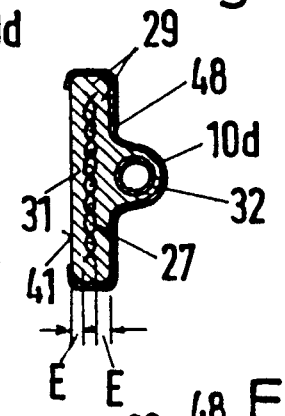
Figure 7:
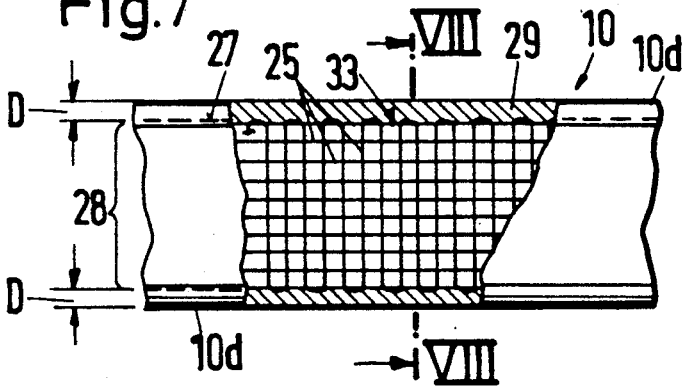
Figure 8:
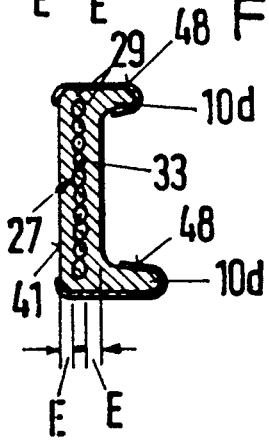
Figure 9:
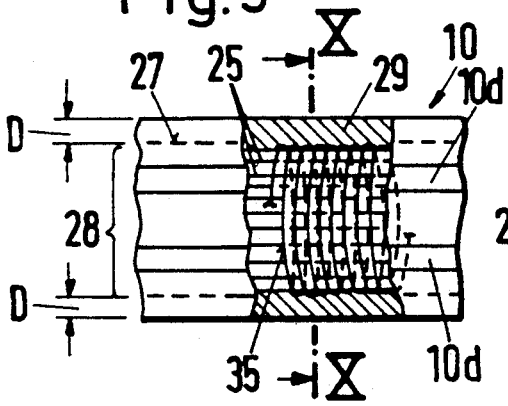
Figure 9A:
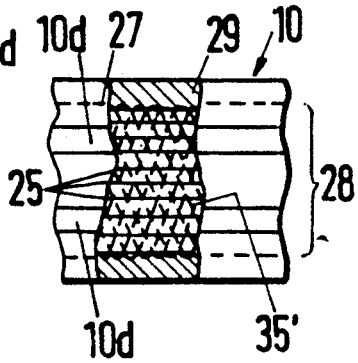
Figure 10:
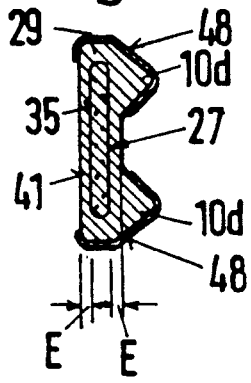
Figure 11:
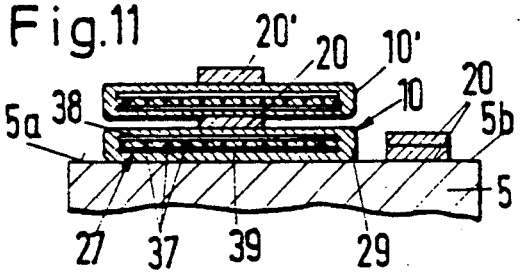
Figure 14:
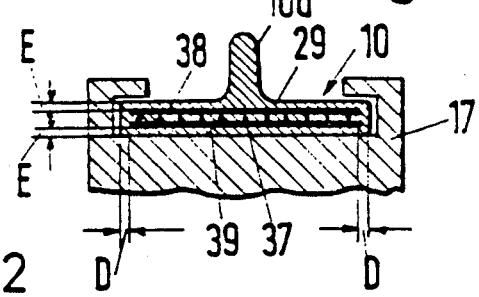
Figure 12:
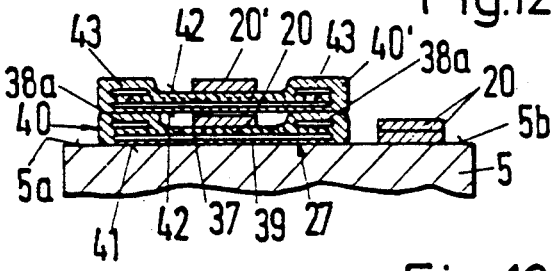
Figure 15:
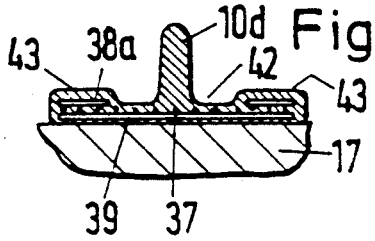
Figure 13:
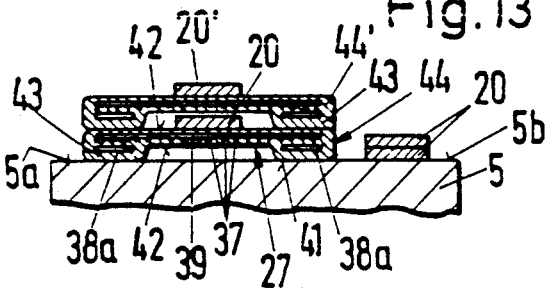
Figure 16:
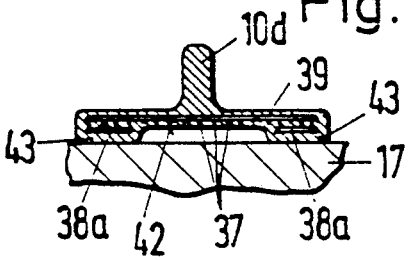

FIG. 2*a* illustrates a detailed view of the picking belt of FIG. 2;

FIG. 3 illustrates part of a modified picking belt in plan view along arrow III in FIG. 2 and partly in section;

FIG. 4 illustrates a view taken on line IV—IV of FIG. 3;

FIG. 5 illustrates a modified picking belt in accordance with the invention;

FIG. 6 illustrates a view taken on line VI—VI of FIG. 5;

FIG. 7 illustrates a further modified picking belt in accordance with the invention;

FIG. 8 illustrates a view taken on line VII—VII of FIG. 7;

FIG. 9 and 9*a* each illustrate a part of a picking belt in another variant embodiment;

FIG. 10 illustrates a view taken of line X—X of FIG. 9;

FIG. 11, 12 and 13 each show arrangements of picking belts, each in another embodiment and each in section along line XX—XI in FIG. 1;

FIGS. 14, 15 and 16 each show the picking belts in FIGS. 11, 12 and 13, each in cross-section corresponding to line XIV—XIV in FIG. 1, and FIGS. 17, 18, 19, 20, 21 and 22 each illustrate corresponding cross-sections of picking belts of other embodiments of the invention.

FIG. 1 shows part of machine frame 1 and a batten 2 of a belt gripper weaving machine of known construction. The machine frame 1, on the left side and on the right side, contains a respective bearing part 3, on which a belt wheel 5 of a picking mechanism is totally disposed. FIG. 1 shows only the left side of the machine frame 1 with the bearing part 3, disposed in mirror image position relative to the right-hand bearing part, and the belt wheel 5, disposed in mirror image position with respect to the right-hand belt wheel. A reed 6 is secured to the batten 2 and warp threads 7, 8 are guided through the reed 6. An and 10*a* of a flexible picking belt 10 belt wheel 5, whereas the other free end 10*b* is connected to the gripper head 11 adapted to grip an end 12*a* of a weft thread 12. A corresponding picking belt, likewise comprising a gripper head, is secured to the right-hand belt wheel.

The two belt wheels 5 are each driven in oscillation and in opposite directions, so that the gripper heads 11 are correspondingly moved into or out of the shed 13 formed by the warp threads 7, 8. The gripper heads 11 are moved along the batten 2 to the middle of the shed 3 and subsequently withdrawn therefrom. The end 12*a* of the weft thread 12 is delivered to the gripper head on the right-hand side of the weaving machine outside the shed 13. The weft thread 12 is picked by the gripper head into the first half of the shed 13 and, in the middle of shed 13, is delivered to the gripper head 11 disposed on the left picking belt 10, which then picks the weft thread 12 into the second half of the shed 13. At the end of the picking operation, the reed 6 at the top of shed 13 beats the weft thread 12 into the woven cloth 14.

In other kinds of belt gripper weaving machines, the picking mechanism may also comprise a single belt wheel 5 and a single picking belt 10 driven from one side of the weaving machine over the entire weaving width and back again, so that the gripper head performs a complete pick on each occasion.

In the embodiment shown during operation, the picking belt 10 moves in the direction of arrow 15 when unwinding from the belt wheel 5 to guide the gripper head 11 from an operating position outside the shed 13 and shown in FIG. 1, towards the middle of the shed 13 and subsequently back to the operating position shown when the picking belt 10 is wound onto the belt when 5 in the direction of arrow 15*a*. After each change of shed, the gripper head 11 is returned to the middle of the shed 13 for a new pick. In the operating position shown in FIG. 1, the picking belt 10 is wound on the periphery of belt wheel 5 with an angle of wrap of more than 360°, e.g. 460° and, from the place 16 where the belt 10 runs off the belt wheel 5, is guided in a straight longitudinal portion over a guide rail 17 towards a guide track 18 on the batten 2. As shown, the guide rail 17 has an inverted T-shaped slot running the length of the guide rail 17 to slidably receive the belt 10 widthwise.

The part of the picking belt 10 on the belt wheel 5 at a given time is surrounded by a clamping belt 20 which prevents the picking belt 10 from rising. One end of the clamping belt 20, together with the end 10*a* of the picking belt 10, is secured by the clamping member 9 in a first wrap region 5*a* on the periphery of belt wheel 5, and is guided by two pulleys 21, 22 towards a second wrap region 5*b*, the clamping belt 20—when the picking belt 10 is wound up as shown—is guided over the periphery of the belt wheel 5 with a wrap angle of more than 360°, e.g., 620°, and secured thereto by a clamping member 23. This arrangement is described in detail in European Patent Application 0253184.

Referring to FIG. 2, longitudinal portion A of the picking belt 10 for winding onto the belt wheel 5 is given a basic cross-section defined by a flat rectangular contour, whereas an adjacent end portion B has a web-like raised part 10*d* which, together with a flange part 10*c* defined by the basic cross-section for moving in the slot in the guide rails 17 forms a substantially T-shaped cross-section. The end portion B, which is stretched, remains between the run-off place 16 and the shed 13 (see FIG. 1), even when the picking belt 10 has been completely pulled back from the shed 13, and the belt wheel 5 is correspondingly completely wound as in FIG. 1.

As shown in FIG. 2, the picking belt 10 comprises a strip-like body having, a sectional part with an originally constant T-shaped cross-section along its entire length. A portion 10*d*′ of the raised part 10*d* extending over the longitudinal portion A of belt 10 (shown chain-dotted in FIG. 2), has been removed down to the flange part 10*c*, e.g. by cutting off. This embodiment permits use of a sectional part manufactured by a continuous process, e.g. drawing, casting and/or pressing, more particularly pultrusion.

The picking belt 10 is made from a plastics part reinforced by fibers 24, e.g. carbon, glass or Kevlar fibers, and manufactured e.g. from epoxy or phenolic material. As shown in FIG. 2*a*, the fibers 24 are combined into threads 25 extending along the picking belt 10, or into corresponding groups, e.g. strands or bunches of fibers, which form a belt-like insert extending all the way along the picking belt 10 and having a width and thickness less than the width C or thickness T of the basic cross-section of the picking belt 10.

As shown in FIGS. 3 and 4, the longitudinally extending threads 25 or fiber groups can be surrounded by a fibrous web 26 made up of fibers. The resulting insert 27 extends through the picking belt along its entire length inside an inner cross-sectional part 28, surrounded on all sides by an outer cross-sectional part 29 of belt 10, free from the fibers of the insert 27 and formed by a layer of the plastics constituting the picking belt 10. The raised part 10*d* extending over the end portion B of the belt is formed by a corresponding web-like continuation of part 29. The outer cross-sectional part 29, which is free from fiber groups and has a thickness D or E which can be chosen in accordance with the wear occurring on the picking belt 10 during operation, can prevent exposure of the bunched fibers, thus, correspondingly increasing the service life of the picking belt 10 and correspondingly reducing the idle times of the weaving machine. The raised part 10*d* can be given any required width, e.g. a third to a tenth of the width of the picking belt 10.

Referring to FIGS. 5 and 6, wherein like reference characters indicate like parts as above, a picking belt 10 may have, an insert 27 comprising a strip of a woven cloth 31 formed from the fiber groups or threads 25. In this embodiment, the raised part 10*d* has a longitudinally extending, reinforcing bearing member 32 surrounded in cross-section on all sides by the plastics constituting the picking belt 10. As shown, the bearing member 32 can be a tube made of a correspondingly harder plastics.

Referring to FIGS. 7 and 8, wherein like reference characters indicate like parts as above, a picking belt 10 may have an insert 27 in the form of a belt 33 woven from the thread groups or threads 25 and an end portion B formed with two raised parts 10*d* extending along the side edges and given the same height or, as shown in the drawing, different heights.

Referring to FIGS. 9 and 10, a picking belt 10 may have an insert 27 formed by longitudinally extending fiber groups or threads 25, disposed in a thread 35 wound round them in a helix. In this embodiment, the end portion B of the belt 10 is formed with two raised parts 10*d* of triangular cross-section each having a maximum width, as shown, of about one-third the width of the picking belt 10.

As shown in FIG. 9*a*, the threads 25 can be surrounded by a thread 35′ wound in a number of layers or by a corresponding tubular sheath formed e.g. by a plaited or knitted or woven structure or a fibrous web.

Referring to FIG. 11, in the operating position shown, a picking belt 10 is wrapped round the entire periphery of a belt wheel 5 and, in turn, is wrapped round by a clamping belt 20 and, over an additional wrapping angle of e.g. 100°, is covered by a second layer 10′ of the picking belt 10 and a second layer 20′ of the clamping belt 20 wound in the second wrapping region 5*a* of the belt 5.

As shown in FIG. 11, the insert 27 of the picking belt 10 comprises a plurality of longitudinally extending threads of fiber strands 37, which over their entire length, are disposed between two layers of transversely extending threads or corresponding fiber strands 38, 39, disposed inside an inner cross-sectional part and within an outer cross-sectional part 29 of the belt 10.

FIG. 14 shows the end portion B of the belt 10 of FIG. 11 guided in a guide rail 17 and having a raised part 10*d* projecting from the outer cross-sectional part 29.

In the embodiment in FIGS. 12 and 15, the belt wheel 5 is surrounded by a picking belt 40 which, in the peripheral region shown, is wrapped round by a layer 40' of the picking belt 40. The upper side of the belt 40 remote from a running surface 41 is formed with a longitudinally extending slot-like recess 42 having a width and depth at least equal to the width and thickness, respectively, of the clamping belt 20 for pressing against the picking belt 40. In this embodiment, the insert 27 is formed by fiber strands 37, 39 extending across the entire width of the inner cross-sectional part 28 and by two layers of transversely disposed fiber strands 38*a*, which extend through the edge parts 43 of the belt 40 extending on each side of the recess 42 in the inner cross-section part 28 surrounded by non-reinforced plastics material. Correspondingly, in the region of the belt wheel 5 covered by windings, the edge parts 43 of the second layer 40' of the picking belt 40 can be disposed directly on the edge parts 43 of the portion of belt 40 directly surrounding the belt wheel 5, thus positioning the second layer 40' so as to prevent the layer 40' from sliding sideways. As shown in FIG. 15, a raised part 10*e* extends over the end portion B of the belt 40 and is disposed in the recess 42 projecting from the base surface thereof.

As shown in FIGS. 13 and 16, the recess 42 receiving the clamping belt 20 can also be formed on the running surface 41 facing the belt wheel 5 of a picking belt 44 which can be wrapped round by a second layer 44'. The raised part 10*d* is formed in the end portion B on the cross-sectional part of the picking belt 44 bridging the recess 42.

Figure 17:
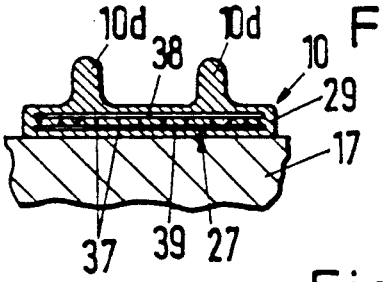
Figure 18:
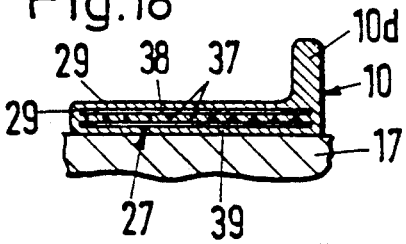

The picking belt 10 can be formed with two raised parts 10*d* extending over its end portion B as in FIG. 17, or with a single raised part 10*d* projecting from one of the lateral edge parts as in FIG. 18.

Figure 19:
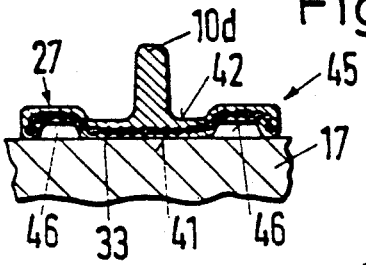

FIG. 19 shows a picking belt 45 formed with a central recess 42 on an upper surface and also with two recesses 46 on a running surface 41 along the side edges. The belt 45 accordingly has an approximately wavy thin-walled cross-section having an inner part through which a correspondingly wavy cross-section insert 27 extends which, in the embodiment shown, consists of a woven belt 33. The result is a low-weight construction of the picking belt 45, so as to ensure high flexibility in the length portion for winding onto the belt wheel 5, combined with high rigidity in the end portion B of the belt 45 reinforced by the raised part 10*d*.

Figure 20:
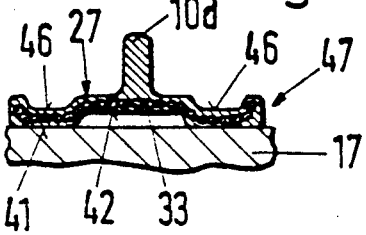

FIG. 20 shows another profiled, correspondingly low-weight picking belt 47, having a cross-section defined by a central recess 42 formed on the running surface 41 and two recesses 46 formed on the upper surface along the side edges.

As shown in FIGS. 4, 6, 8 and 10, the picking belt can be provided with a protective layer 48 of wear-resistant material, e.g. a lubricant varnish or corresponding plastics or a thin sheet-metal cover, at least on the end portion B containing the raised part and coming into contact with the warp threads 7, 8 of the shed 13 each time the shed closes. The protective layer 48 can extend only over the raised part 10*d* as in FIG. 4, or over the two sides of a belt 10 and the entire upper surface remote from the running surface 41, as in FIG. 6. In the constructions in FIGS. 8 and 10, the protective layer 48 extends over both raised portions 10*d* and the two side surfaces of belt 10. Of course, the picking belts shown in FIGS. 11 to 20 can also be provided with at least one corresponding protective layer 48.

In another possible construction, in which the picking belt has a cross-section which is constant over the entire length and defined by a rectangular contour, the picking belt can be given a raised part extending over the entire length inside the rectangular contour, or alternatively can be without a raised part. Instead of a raised part incorporated in the cross-section of the picking belt, an e.g. web-like or otherwise constructed reinforcing part or a corresponding holder part for the gripper head can be secured to the end portion B of the picking belt.

Figure 21:
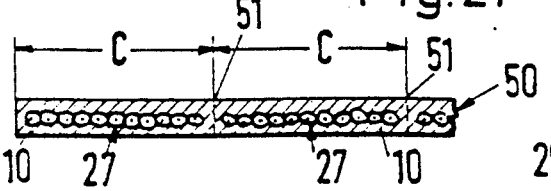
Figure 22:
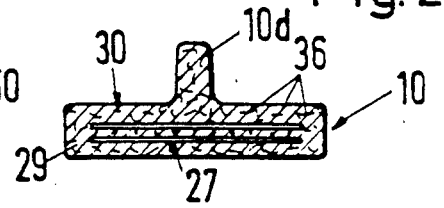

As shown in FIG. 21, a picking belt 10 can also be made from strips of a plastics plate 50, reinforced by belt-like inserts 27 disposed at suitable intervals from one another. The inserts 27 are separated by cross-sectional regions free from groups of fibers, and through which cuts 51 can be made for producing the picking belts 10. This embodiment particularly can greatly reduce the cost of machining the side edge parts of belts 10, as compared with prior-art constructions.

The picking belts 10, 40, 44, 45, 47 may also be reinforced by a respective additional insert 30 made up of a number of individual short fiber portions 36 distributed over at least a portion of the outer cross-sectional part 29. In the embodiment shown in FIG. 22, the fiber portions 36 are distributed over the entire outer cross-sectional part 29 and the cross-section of the raised part 10*d* and are embedded in the plastics constituting the picking belt 10. This embodiment is particularly suitable for a weaving operation using less sensitive warp material, since any fiber portions 36 from the additional insert 30 which become exposed through wear of the plastics can be broken relatively easily (in contrast to bunched groups of fibers) or can come off with the worn plastics and thus, if they cling to relatively coarse warp yarn, cannot appreciably interfere with the weaving operation.

The picking belts 10, 40, 44, 45, 47 can be made either from duroplastics in conventional manner or from a correspondingly fiber-reinforced thermosetting plastics. This is a particularly simple, inexpensive method of manufacturing the picking belt and takes much less time than in previous constructions, mainly because no polymerization phase is required in the processing of thermosetting plastics. Examples of possible thermosetting plastics are: polyether ether ketones (PEEK), polyphenylene sulphides (PPS), polyamides (PA), polycarbonates (PC), polyether imides (PEI) and semi-finished thermoplastic carbon fibers such as "prepregs".

The invention thus provides a picking belt of reinforced construction wherein a reinforcing insert of fibers is precluded from exposure to the outer surfaces of the belt during use.

The invention also provides a picking mechanism of relatively long operating life. In addition, the invention provides a picking mechanism which does not require frequent stops in order to change a picking belt due to projection of reinforcing fibers therefrom.

What is claimed is:

1. A picking belt for a gripper weaving machine comprising a strip-like plastic body of flat rectangular cross-section; and a longitudinally extending insert within said body, said insert being disposed in inwardly spaced relation to each outer surface of said body and including a plurality of longitudinally extending reinforcing fibers and a plurality of fibers extending across said reinforcing fibers in surrounding relation relative to the width of said insert.

2. A picking belt as set forth in claim 1 which further comprises a plurality of reinforcing fibers disposed in an outer cross-sectional part of said body outside of said insert.

3. A picking belt as set forth in claim 1 wherein said body includes at least one longitudinally extending slot-like recess in at least one surface thereof.

4. A picking belt as set forth in claim 3 wherein said recess is of a width and depth to receive a clamping belt for clamping said picking belt against a belt wheel.

5. A picking belt as set forth in claim 1 which further comprises at least one raised part projecting from a surface of said body and extending longitudinally over at least part of the length of said body.

6. A picking belt as set forth in claim 5 which further comprises a reinforcing bearing member extending longitudinally within said raised part.

7. A picking belt as set forth in claim 5 wherein said raised part extends over an end portion of said body disposed between a shed and a belt wheel with said body in a wound position on the belt wheel.

8. A picking belt as set forth in claim 7 which further comprises a protective layer of wear-resistant material covering at least part of said end portion.

9. A picking belt as set forth in claim 1 wherein said plastic body is made of a thermosetting plastic.

10. A picking mechanism in a gripper weaving machine comprising an oscillating belt wheel;

a gripper head for reciprocating into and out of a shed of wrap yarns; and a flexible picking belt secured at one end to said wheel for winding thereon and at a second end to said gripper head for reciprocating said head, said belt including a plastic body of flat cross-section and a longitudinally extending insert within said body, said insert being disposed in inwardly spaced relation to each outer surface of said body and including a plurality of longitudinally extending reinforcing fibers and a plurality of fibers extending across said reinforcing fibers in surrounding relation relative to the width of said insert.

11. A picking mechanism as set forth in claim 10 further comprising a guide rail between said wheel and said gripper head having an inserted T-shaped slot slidably receiving an end portion of said belt, said belt having at least one raised part on said end portion projection from a surface of said body through said slot in said rail.

12. A picking mechanism as set forth in claim 10 wherein said belt further comprises a plurality of reinforcing fibers disposed in an outer cross-sectional part of said body outside of said insert.

13. A picking mechanism as set forth in claim 10 wherein said body includes at least one longitudinally extending slot-like recess in at least one surface thereof.

14. A picking mechanism as set forth in claim 13 which further comprises a clamping belt received in said recess to clamp said picking belt onto said belt wheel.

15. A picking mechanism as set forth in claim 10 which further comprises at least one raised part projecting from a surface of said belt and a wear resistant protective layer covering said raised part.

16. A picking mechanism in a gripper weaving machine comprising an oscillating belt wheel;

a gripper head for reciprocating into and out of a shed or warp yarns;

a flexible belt secured at one end to said wheel for winding thereon and at a second end to said gripper head for reciprocating said head, said belt including a plastic body and a longitudinally extending insert within said body, said insert being disposed in inwardly spaced relation to each outer surface of said body and including a plurality of longitudinally extending reinforcing fibers; and a guide rail between said wheel and said gripper head slidably receiving an end portion of said belt, said belt being slidably guided in said rail and having at least one raised part on said end portion projecting from a surface of said body.

17. A picking mechanism in a gripper weaving machine comprising an oscillating belt wheel;

a gripper head for reciprocating into and out of a shed of warp yarns;

a flexible belt secured at one end to said wheel for winding thereon and at a second end to said gripper head for reciprocating said head, said belt including a plastic body having at least one longitudinally extending slot-like recess in at least one surface thereof and a longitudinally extending insert within said body, said insert being disposed in inwardly spaced relation to each outer surface of said body and including a plurality of longitudinally extending reinforcing fibers; and a guide rail between said wheel and said gripper head slidably receiving an end portion of said belt, said belt being slidably guided in said rail and having at least one raised part on said end portion projecting from a surface of said body.

18. A picking mechanism as set forth in claim 17 which further comprises a clamping belt received in said recess to clamp said picking belt onto said belt wheel.

* * * * *

UNITED STATES PATENT AND TRADEMARK OFFICE

CERTIFICATE OF CORRECTION

PATENT NO. : 5,035,268

DATED : July 30, 1991

INVENTOR(S) : Robert Bucher

It is certified that error appears in the above-identified patent and that said Letters Patent is hereby corrected as shown below:

Column 1, line 55, change "within the outer" to -within the body which is disposed in inwardly spaced relation to each outer-;

Column 2, line 40, change "XX-XI" to -XI-XI-;

2, line 59, change "10 belt" to -10 is secured by a clamping member 9 to the periphery of the left belt-;

Column 4, line 20, change "fibers" to -fibers 24-.

Signed and Sealed this

Twenty-third Day of November, 1993

*Attest:*

Bruce Lehman

BRUCE LEHMAN

*Attesting Officer*

*Commissioner of Patents and Trademarks*